United States Patent [19]

Lock et al.

[11] Patent Number: 4,693,286

[45] Date of Patent: Sep. 15, 1987

[54] FLUID FILLING APPARATUS

[75] Inventors: Brian E. Lock, Princeton; Jeffrey S. Wojnar, East Windsor, both of N.J.

[73] Assignee: RCA Corporation, Princeton, N.J.

[21] Appl. No.: 873,959

[22] Filed: Jun. 13, 1986

[51] Int. Cl.[4] ..... B65B 31/00

[52] U.S. Cl. ..... 141/61; 141/245; 141/260; 92/15; 222/389

[58] Field of Search ..... 141/1-12, 141/37-67, 285-310, 250-284, 234-248; 92/15; 222/386-399

[56] References Cited

U.S. PATENT DOCUMENTS

| | | | |
|---|---|---|---|
| 2,678,761 | 5/1954 | Warren et al. | 141/46 |
| 2,874,732 | 2/1959 | Zepelovitch | 141/30 |
| 3,282,306 | 11/1966 | Greenhut | 141/7 |
| 3,348,587 | 10/1967 | Grothoff | 141/46 |
| 3,590,889 | 7/1971 | Vannus | 141/18 |
| 4,540,144 | 9/1985 | Perrella | 141/46 |
| 4,569,378 | 2/1986 | Bergandy | 141/266 |

*Primary Examiner*—Houston S. Bell, Jr.

*Attorney, Agent, or Firm*—Joseph S. Tripoli; William Squire

[57] ABSTRACT

A piston is forced in a direction to disengage from a cylinder containing a fluid such as an adhesive. The piston while in engagement with the cylinder abuts a stop in response to the disengagement force. While the disengagement force is kept on the piston, the chamber between the fluid and piston in the cylinder is evacuated. After evacuation, the disengagement force on the piston is gradually released and the piston is forced against the fluid to squeeze the fluid through fluid couplings into an array of corresponding containers releasably secured to the piston, simultaneously filling the containers without exposing the fluid to air.

8 Claims, 2 Drawing Figures

Figure 1:
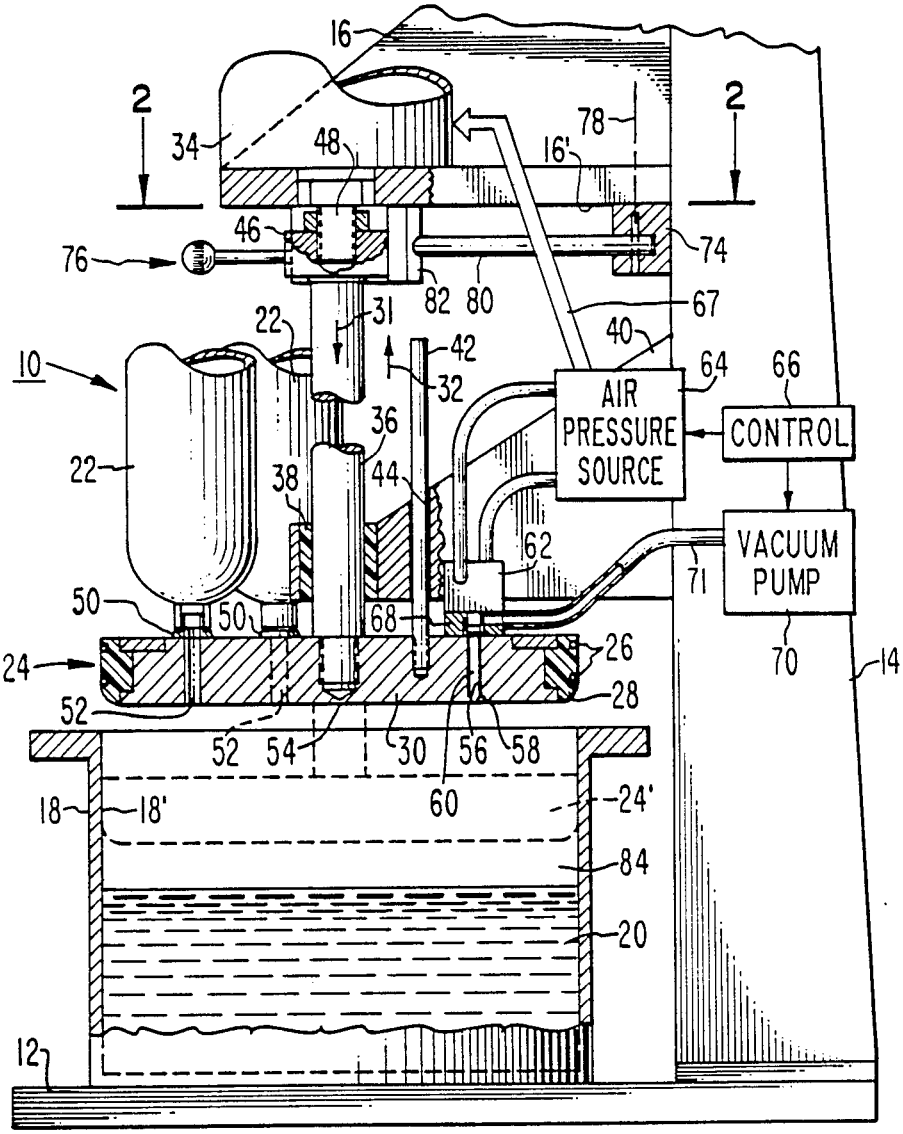

FLUID FILLING APPARATUS present invention relates to an apparatus for filling a container with a fluid, especially liquids.

In certain manufacturing operations adhesives are used for gluing different components together during assembly. In one system, an adhesive is employed which is required to be utilized without subsequent exposure to moisture in air which is detrimental to the adhesive. The adhesive is liquid in consistency and, once mixed, should be isolated from the moisture during its entire processing cycle until applied to the parts being glued. One solution to this problem is to fill containers with the adhesive and sealing the containers so filled from the atmosphere until utilized in the manufacturing system.

Filling such containers in the absence of moisture requires a system which is able to fill such containers in an evacuated environment. A problem with this kind of system is that the evacuation of a chamber to remove atmospheric air prior to filling the container imposes atmospheric forces on the piston elements of the filling system due to the presence of the vacuum. Such atmospheric forces tend to provide high friction loads on the mechanical components of the filling system tending to lock the components in place and preclude their release for subsequent operation of the filling mechanism.

In an apparatus according to the present invention for airless filling a container with fluid, a piston system comprises a piston cylinder for receiving the fluid. A piston selectively engages the cylinder. Means are provided for selectively applying a force on the piston in a direction tending to displace the piston out of engagement with the cylinder. Means are provided for selectively precluding the piston from disengagement with the cylinder during the application of the force. Means are provided to create a vacuum in the chamber formed by the piston and engaged cylinder during the application of the force. Means displace the piston into the cylinder after the vacuum is formed. Thus, by applying a force on the piston in a direction opposite the engagement direction with the cylinder, atmospheric forces on the piston, due to the presence of a vacuum in the chamber are overcome and the tendency to lock the piston in place due to such forces is minimized.

Figure 2:
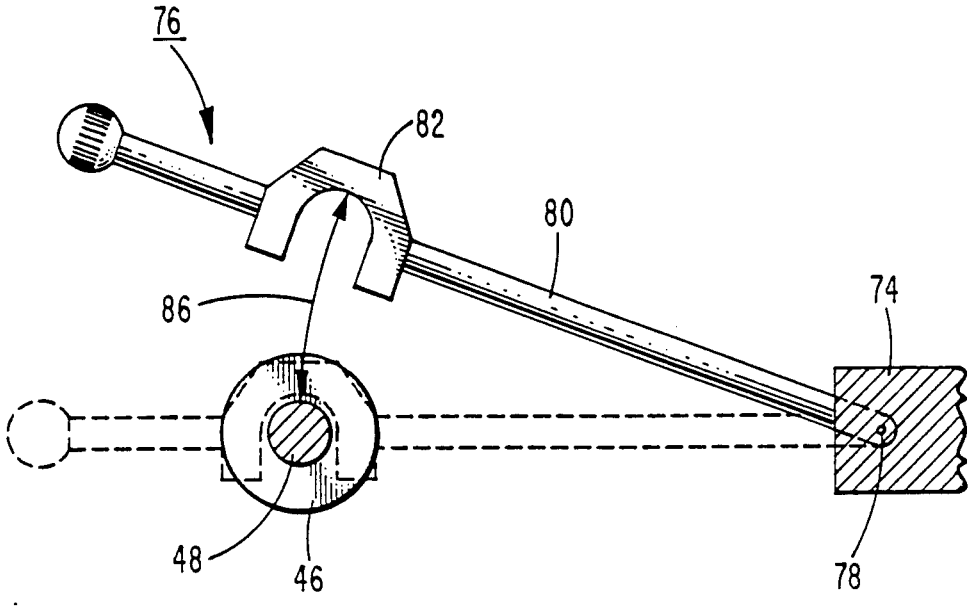

In the drawing:

FIG. 1 is a side elevational view, partially in section, of an apparatus according to one embodiment of the present invention; and FIG. 2 is a plan sectional view of the apparatus of FIG. 1 taken along lines 2—2.

In FIG. 1, apparatus 10 includes a base 12 and an upright support pillar 14. Cantilevered ribbed member 16 is secured to support 14 spaced from base 12. A circular cylindrical receptacle or mixing chamber 18 is releasably secured to base 12 and is filled with a fluid 20 which is to be put into containers 22. The fluid 20 is a liquid and, in this embodiment, is an adhesive. The fluid 20 is placed in the receptacle 18 by other apparatus not shown. Receptacle 18 has a circular cylindrical cavity 18'. Cavity 18' serves as a circular cylindrical cylinder having a mating piston 24.

Piston 24 has a pair of annular O-rings 26 at its circular peripheral edge 28 which sealingly engage the wall of cavity 18'. Piston 24 comprises a generally planar circular disc 30 which is driven in direction 31 into the cavity 18' and out of the cavity in direction 32 by pneumatic cylinder 34 via piston rod 36. Cylinder 34 is selectively operated by pressurized air from source 64 in response to control 66.

Pneumatic cylinder 34 is supported by the cantilevered member 16. Circular cylindrical collar assembly 46 secures pneumatic cylinder 34 shaft 48 to rod 36. Rod 36 mates with and slides in bushing 38 secured to member 40 cantilevered from pillar 14 in the space between member 16 and base 12. A guide rod 42 is secured to disc 30 and is slidably secured in a circular cylindrical opening 44 in member 40. Rod 42 guides the disc 30 to maintain its angular orientation about rod 36 as it is displaced in directions 31 and 32.

A circular array of fluid coupling fittings 50 is secured adjacent corresponding apertures 52 in disc 30. Fittings 50 couple surface 54 of disc 30 facing cavity 18' to the ambient atmosphere on the side of disc 30 opposite surface 54 when O-rings 26 engage cavity 18'. Each fitting 50 is adapted to closely receive a fluid container 22. In this example, there are four fittings 50 (only two being shown). More or fewer fittings may be provided in accordance with a given implementation. The interior of each container 22 is in fluid communication with surface 54 and cavity 18' of receptacle 18 when piston 24 is in engagement with cavity 18'. Each container 22 has a movable seal (not shown) spaced from it's inlet at a fitting 50.

Disc 30 has an aperture 56 which fluid couples surface 54 with the opposite surface of disc 30. Aperture 56 is formed with a tapered valve seat 58 adjacent surface 54. A rod-like valve member 60 in aperture 56 has a tapered end which mates with seat 58. The other end of valve member 60 is coupled to air cylinder 62. Air cylinder 62 is driven by a source of air pressure 64 under control of a solenoid control 66.

In operation of the valve formed by valve member 60 and valve seat 58, control 66 selectively opens the valve by supplying air pressure to cylinder 62 in a manner such that the valve member 60 is displaced in direction 32 away from seat 58. Control 66 selectively closes the valve by supplying air pressure 64 from another inlet to displace the valve member 60 in the opposite direction 31 to seat the member 60 on seat 58.

The cylinder 62 is secured to disc 30 by a housing 68. Housing 68 has an interior chamber which is in fluid communication with aperture 56 in disc 30. That chamber is coupled to a vacuum pump 70 by line 71. Pump 70 is controlled by control 66 for selectively evacuating the chamber of housing 68 when the valve member 60 is opened. Pump 70 evacuates the chamber formed by disc 30 with cavity 18' when disc 30 is in engagement with cavity 18'. Disc 30 is not always engaged with cavity 18' to permit fluid 20 to be placed in the cavity. Control 66 also operates source 64 to supply pressurized air to pneumatic cylinder 34 via lines represented by arrow 67 to drive piston rod 36 in a selected one of directions 31 and 32.

A bearing block 74 is secured to pillar 14 and member 16. A stop assembly 76 is pivotally secured to block 74 for rotation about axis 78. Stop assembly 76 comprises a rod 80 and a U-shaped stop member 82. In FIG. 2, stop assembly 76 is shown in solid line in the disengaged position. The stop member 82 serves as a yoke which sits in the space between collar 46 and surface 16' of member 16, FIG. 1, after the piston 24 is displaced into engagement with the receptacle 18 cavity 18' as shown in phantom at 24'. The stop member 82 is so shaped and constructed, e.g., it is made of steel or other high strength material in compression, to withstand squeezing forces of collar assembly 46 in direction 32, FIG. 1. The squeezing forces compress stop member 82 against member 16. This action stops displacement of rod 36 in the upward direction 32 in the presence of a pneumatic force in that direction induced by the air pressure from source 64 to cylinder 34. The stop member 82 stops piston 24 from displacing in direction 32 while the piston 24 is in engagement with the receptacle cavity 18'. The stopped piston forms a sealed chamber 84 with cavity 18' while the pneumatic force is applied to the piston 24 in direction 32.

The application of the force in direction 32 serves an important function as will now be explained. After the fluid 20 is filled in the cavity 18', the receptacle 18 is placed in position as illustrated. It is locked and aligned with the piston 24 by an alignment mechanism (not shown). At this time the piston 24 is above the receptacle 18 as shown in solid lines and the chamber 84 is open in fluid communication with the ambient In an initial step, rod 36 and piston 24 are slowly displaced downward in direction 31 by control 66 and source 64 until the piston 24 engages cavity 18' as shown in phantom at 24'. When in that position the stop member 82, FIG. 2, is swung in direction 86, FIG. 2, from the position shown in solid lines. Member 82 is rotated until it embraces shaft 48 and is interposed between collar assembly 46 and surface 16' of member 16. When the stop member 82 is so positioned, as shown in phantom in FIGURE 2, air pressure from source 64 is supplied to cylinder 34, FIG. 1, to lift the piston 24 in direction 32, tending to disengage the piston 24 from cavity 18'. However, stop member 82 precludes piston 24 from displacing out of the cavity 18'. The pneumatic force on piston 24 forces the piston 24 and rod 36 against stop member 82 and thus member 16. Stop member 82 thus locates piston 24 in cavity 18'.

While the piston is so locked and that pneumatic force is so applied, the vacuum pump 70 is operated, the valve member 60 being opened by cylinder 62. The vacuum pump 70 evacuates the chamber 84 between piston 24 and cavity 18'. Due to fluid coupling of the containers 22 to cavity 18', the containers 22 are also evacuated. The movable seal (not shown) in each container is open to the atmosphere on one side and is forced toward fitting 50 as the container is evacuated. When a suitable vacuum has been reached in chamber 84, cylinder 62 is operated to close the valve member 60. The vacuum pump 70 is then stopped.

Because of the vacuum in chamber 84, very large atmospheric forces are exerted on the disc 30 of piston 24 in direction 31. Such forces would need to be counteracted by a mechanical stop (not shown) for holding the piston 24 in place during the evacuation process. However, such forces tend to create a high frictional load on such a stop tending to mechanically lock the piston to that stop after evacuation of the chamber 84. A pneumatic force in direction 32 opposite the direction 31 of the atmospheric forces counteracts those atmospheric forces. That force counteraction in direction 32 holds the piston in place and relieves any high static friction forces on a mechanical stop that would otherwise be needed to hold the piston in place during evacuation of chamber 84.

Before the desired vacuum in chamber 84 is reached, the air pressure from source 64 is applied to cylinder 34 to apply a force in direction 32 and relieve the piston 24 from the ambient atmospheric pressure exerted on piston 24 by the subsequent vacuum in chamber 84. A gradually reduced pneumatic force (due to flow restriction valves (not shown) and change in force direction) is applied to the piston 24 in direction 31 so that the piston 24 is displaced slowly and gradually in direction 31 into chamber 84 toward fluid 20. Displacement of piston 24 in direction 31 continues until the piston 24 reaches the fluid 20. As the piston 24 approaches the fluid 20, the air pressure from source 64 is gradually increased to displace rod 36 in direction 31 forcing piston 24 against the fluid 20. This action forces the fluid 20 through the apertures 52 in disc 30 into the containers 22. All containers attached to the fittings 50 are filled simultaneously. As the containers fill, the movable seal displaces away from fitting 50 in response to the fluid pressure.

Those fittings 50 which are not coupled to containers can be plugged by plugs (not shown). In this way, the containers 22 can be filled without the presence of air or other ambient atmospheric contamination. During the filling procedure, as mentioned above, the valve member 60 is seated on valve seat 58 and the valve is closed, thus precluding fluid 20 from entering that valve mechanism. After containers 22 are filled, the containers are sealed by a cap (not shown).

What is claimed is:

1. In an apparatus for airless filling a container with fluid, a piston system comprising:

a piston cylinder for receiving said fluid;

a piston selectively engaged with said cylinder;

means for selectively applying a force on said piston in a direction tending to displace the piston out of engagement with said cylinder;

means for selectively precluding the piston from disengagement with the cylinder while applying said force;

means for forming a vacuum in the chamber formed by said piston and engaged cylinder while applying said force; and means for displacing the piston into said cylinder after the forming of said vacuum.

2. Apparatus for airless filling a container with a fluid comprising:

a body having a cylindrical fluid receiving cavity having a longitudinal axis and open at one end thereof to the ambient atmosphere;

a piston adapted to sealingly engage said cavity in a direction parallel to said axis to form with the cavity a sealed chamber;

means for evacuating said ambient atmosphere from said chamber while maintaining said fluid in said chamber;

means for applying an axial force on said piston in a direction tending to disengage the piston from the cavity while evacuating said chamber;

container coupling means adapted to receive said container and fluid coupled to said chamber for receiving said fluid from said chamber; and means for releasing said axial force and for displacing said piston in a direction parallel to said axis into said chamber after evacuating said chamber for forcing said fluid from said chamber into said container coupling means.

3. The apparatus of claim 2 wherein said means for applying an axial force includes stop means coupled to the piston for holding the piston in said sealing engagement with said cavity as said axial force is applied thereto.

4. The apparatus of claim 3 wherein said stop means includes a stop element movably coupled to said body and having a piston stop position and a piston disengage position for selectively preventing said piston from disengaging said cavity only in said piston disengage position.

5. The apparatus of claim 2 wherein said means for evacuating said atmosphere from said chamber includes valve means having open and closed valve states and means for opening said valve means during said evacuating and means for closing said valve means during said displacing of said piston during said forcing of the fluid into the container coupling means.

6. The apparatus of claim 2 wherein said container coupling means includes a plurality of fluid coupling fittings secured to said piston, each fitting adapted to releasably secure a fluid receiving container thereto, each fitting in fluid communication with said chamber.

7. Apparatus for airless filling a container comprising:

a base;

a member having a circular cylindrical cavity secured to the base;

a piston movably secured to the base adapted to mate with and align with said cavity to form a sealed chamber in said cavity when engaged therewith;

means coupled to the base for selectively displacing the aligned piston into and out of engagement with said cavity;

piston stop means having first and second states, said first state engaging said piston for precluding said piston from disengaging from said chamber and a second state for permitting said piston to disengage from said chamber;

means for forcing said piston in one direction against said stop means in said stop means first state;

means for evacuating said chamber while forcing said piston in said one direction;

means for displacing said piston in a second direction opposite the one direction during said second state to reduce the volume of the chamber and force fluid therefrom; and container means coupled to said chamber for receiving fluid when said piston is displaced in said second direction.

8. The apparatus of claim 7 wherein said means for evacuating includes a fluid conduit in said piston, a valve seat coupled to the piston at said conduit, and a valve member in said conduit adapted to mate with the valve seat, and valve member drive means coupled to the valve member for selectively seating the valve member on said seat; and vacuum pump means coupled to said conduit for evacuating a gas from said chamber when the valve member is unseated.

* * * * *